United States Patent [19]

Weisenbach

[11] 4,352,637

[45] Oct. 5, 1982

[54] JET COOLING PUMP

[75] Inventor: Charles O. Weisenbach, Watertown, N.Y.

[73] Assignee: General Signal Corporation, Stamford, Conn.

[21] Appl. No.: 156,522

[22] Filed: Jun. 4, 1980

[51] Int. Cl.[3] ..... F04B 23/10

[52] U.S. Cl. ..... 417/54; 417/76; 417/87; 417/151

[58] Field of Search ..... 417/53, 54, 76, 87, 417/368, 372, 88, 89, 151, 173; 91/507; 60/39.83

[56] References Cited

U.S. PATENT DOCUMENTS

| | | | |
|---|---|---|---|
| 2,982,215 | 5/1961 | Baker | 417/87 |
| 3,304,885 | 2/1967 | Orth | 91/507 |
| 3,332,356 | 7/1967 | Boulet | 103/162 |
| 3,370,423 | 2/1968 | Vaughan | 417/76 X |
| 3,442,093 | 5/1969 | Rietdijk | 417/173 X |
| 3,973,879 | 8/1976 | Ramm | 417/87 X |
| 4,290,736 | 9/1981 | Bernasconi | 417/87 |

FOREIGN PATENT DOCUMENTS

| | | |
|---|---|---|
| 855656 | 11/1952 | Fed. Rep. of Germany . |
| 846907 | 9/1939 | France . |
| 1575216 | 7/1969 | France . |
| 1237867 | 6/1971 | United Kingdom . |

*Primary Examiner*—Carlton R. Croyle
*Assistant Examiner*—Edward Look
*Attorney, Agent, or Firm*—Thomas R. FitzGerald; Jeffrey S. Mednick

[57] ABSTRACT

A main pump has a jet pump powered by the main pump output for forcing a portion of the cooler inlet fluid into the casing chamber of the main pump in order to cool the main pump during periods of low flow.

7 Claims, 2 Drawing Figures

JET COOLING PUMP

BACKGROUND

This invention generally relates to pumps, and in particular, to an apparatus and method for using a jet pump to cool a variable displacement pump.

Variable displacement, axial piston pumps are widely used in aircraft hydraulic systems. During certain flight conditions, the pump will remain in a neutral pumping mode for long periods of time. In neutral, the pump maintains a predetermined system pressure, but pumps only enough fluid to make up system leakage. Hence, the flow of fluid through the pump during its neutral pumping mode is relatively low. In some applications, the normal, high pressure leakage within the pump is insufficient to cool the pump and the hydraulic system.

One solution for cooling the pump and system has been to introduce a predetermined amount of leakage from the pump discharge to the pump casing. One disadvantage of that solution is the additional leakage reduces the overall efficiency of the pump. Another disadvantage is that the energy released by the additional leakage is transferred into heat as the pressure of the fluid drops from the relatively high discharge pressure to the lower casing pressure.

A desirable solution would be to introduce the relatively lower pressure inlet oil into the pump case in order to cool it. However, the pump case fluid is normally at a pressure greater than the inlet fluid so that the inlet fluid will not flow into the case without assistance.

Others have recognized the desirability of using inlet fluid to cool a pump and have provided auxiliary mechanical pumping means in order to achieve that result. See, for example, U.S. Pat. Nos. 4,013,384 and 2,933,044. In the former patent, there is described a centrifugal pumping device which includes cooling passages that are supplied with inlet fluid that is drawn into the pump by the pump's impeller. The latter patent describes a water pumping device which includes an auxiliary impeller to force inlet water through the pump in order to cool it. Still others have used jet pumps for surcharging a pump inlet. See, for example, U.S. Pat. Nos. 4,033,706; 3,989,628; and 3,773,437.

SUMMARY

It is an object of this invention to provide a simple, economical cooling apparatus and method for a pump.

It is a feature of this invention that a jet pump is used to force inlet fluid into the pump casing chamber in order to cool that chamber.

It is another feature of this invention that the jet pump is powered by the discharge of the pump.

The invention includes a main pump having inlet, outlet, and casing chambers with the casing chamber being normally maintained at a pressure and a temperature both of which are greater than the pressure and temperature of the inlet chamber. As such, inlet fluid would not normally flow into the casing chamber without assistance from an auxiliary pumping source. Such a source is provided in the form of a jet pump.

The jet pump has a relatively small discharge orifice through which a high velocity stream of fluid is expelled. That stream is suitably directed towards a port leading to the casing chamber. Hence, fluid discharged through the jet pump orifice will enter the casing chamber. An inlet cavity, in fluid communication with the inlet chamber, is suitably disposed between the jet pump discharge orifice and the casing chamber port. In this manner, the high velocity stream of fluid discharged by the jet pump passes through the inlet cavity fluid and into the casing chamber port. The high velocity discharge stream will entrain a portion of the inlet fluid and carry the inlet fluid into the casing chamber. One skilled in the art can achieve sufficient cooling for the pump by suitably sizing the discharge orifice, the inlet chamber and the casing chamber port.

The jet pump of the invention could be powered by any suitable source of high pressure fluid. In the preferred embodiment, the source of high pressure fluid is the discharge of the pump itself. Accordingly, the invention contemplates using the discharge of the axial piston pump in order to power the pump's own cooling apparatus by forcing inlet oil into the pump casing.

The invention this avoids the disadvantages of excessive leakage and unnecessary heat generation as well as the added expense and complexity of auxiliary pumping impellers. At the same time, the invention enjoys the advantage that part of the normally wasted energy of the high pressure output oil is used to force inlet oil into the pump case for cooling during idle times. During high flow situations, cooling is not critical and is easily accomplished by the large quantity of oil that passes through the pump from inlet to discharge.

The invention as well as its objects and advantages described above will be better understood when considered in connection with the following detailed description and drawing, wherein

DRAWINGS

DETAILED DESCRIPTION

Figure 1:
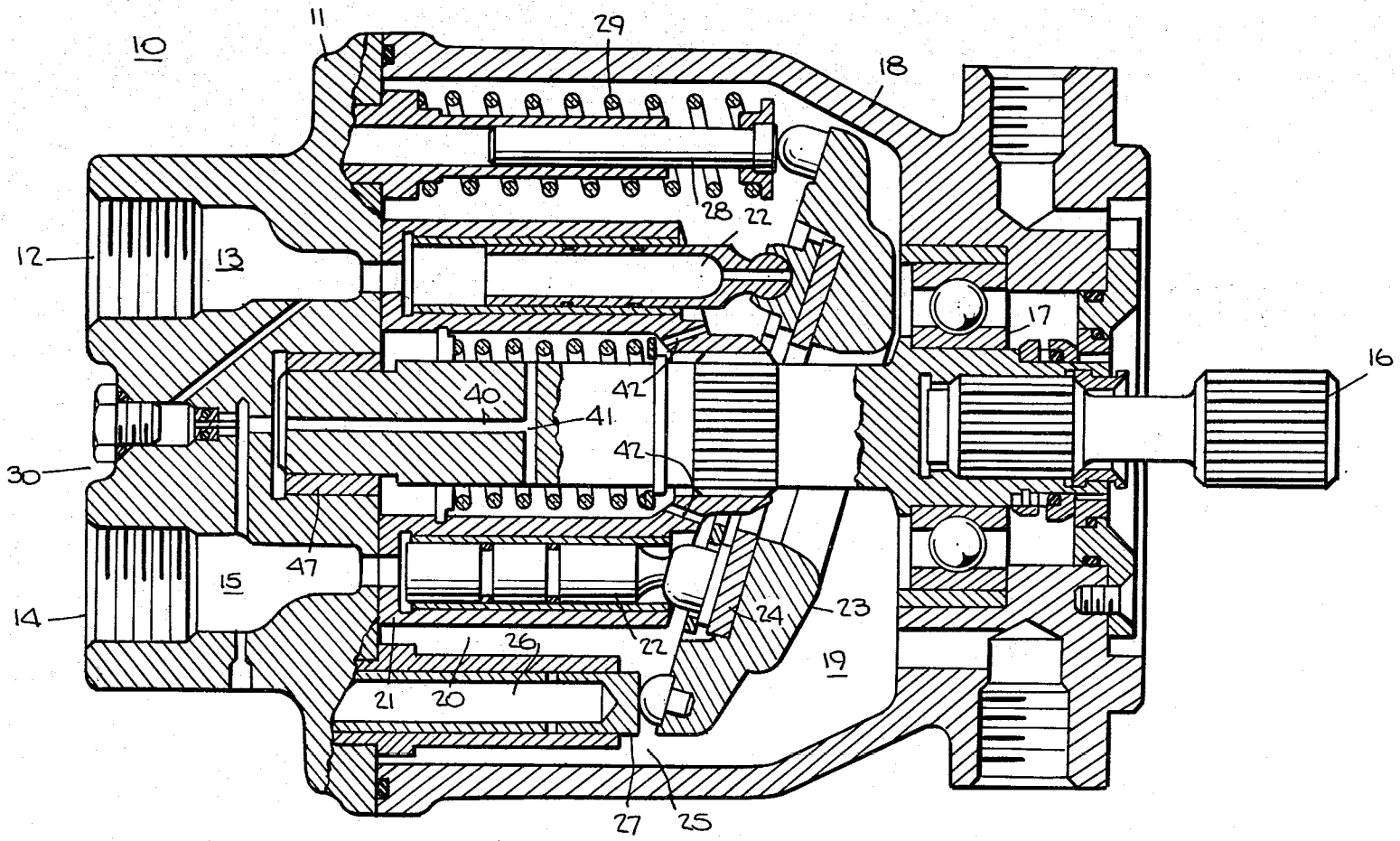
FIG. 1 is a cross-sectional view of a jet cooled, axial piston pump.

With reference to FIG. 1, there is generally shown a pump 10 of the variable displacement axial piston type suitable for use in aircraft hydraulic systems. The pump 10 includes an integral cover and valve plate 11 at one end and a casing 18 enclosing a casing chamber 19. An outlet port 12 in the cover 11 communicates within internal outlet chamber 13; an inlet port 14 communicates with an internal inlet chamber 15. The inlet port 14 is in fluid communication with a pressurized reservoir (not shown). A drive shaft 16 is rotatable mounted in the casing chamber 19 between the bearings 17 and 47. A pumping assembly 20 is positioned symmetrically about the drive shaft 16 and is adapted to pump fluid from the inlet chamber 15 to the outlet chamber 13.

The pumping assembly 20 includes a cylinder block 21 fixed to the drive shaft 16 and adapted to rotate therewith. A plurality of pistons 22 are adapted to reciprocate along linear paths of travel within the cylinder block 21. An adjustable swashplate assembly 23 is attached to one end of each of the pistons in a manner well known in the art. The swashplate assembly 23 includes a standard wear plate 24 adapted to bear against the rotating pistons 22. The angle of the swashplate assembly 23 with respect to the drive shaft axis determines the degree of reciprocation of the pistons 22 and therefore the displacement of the pump 10.

A fluid actuated displacement control mechanism 25 is mechanically connected to the swashplate assembly 23 for controlling the displacement of the pumping assembly 20. The displacement control mechanism 25 includes a displacement control piston 27 actuated by fluid communicated to an internal cylindrical portion 26 of the piston 27. As displacement control fluid is forced under pressure into cylinder 26, or is withdrawn therefrom, the piston 27 translates thereby changing the angle of the swashplate assembly 23. A passive piston 28 is held engaged with the swashplate assembly 23 by a return spring 29.

Figure 2:
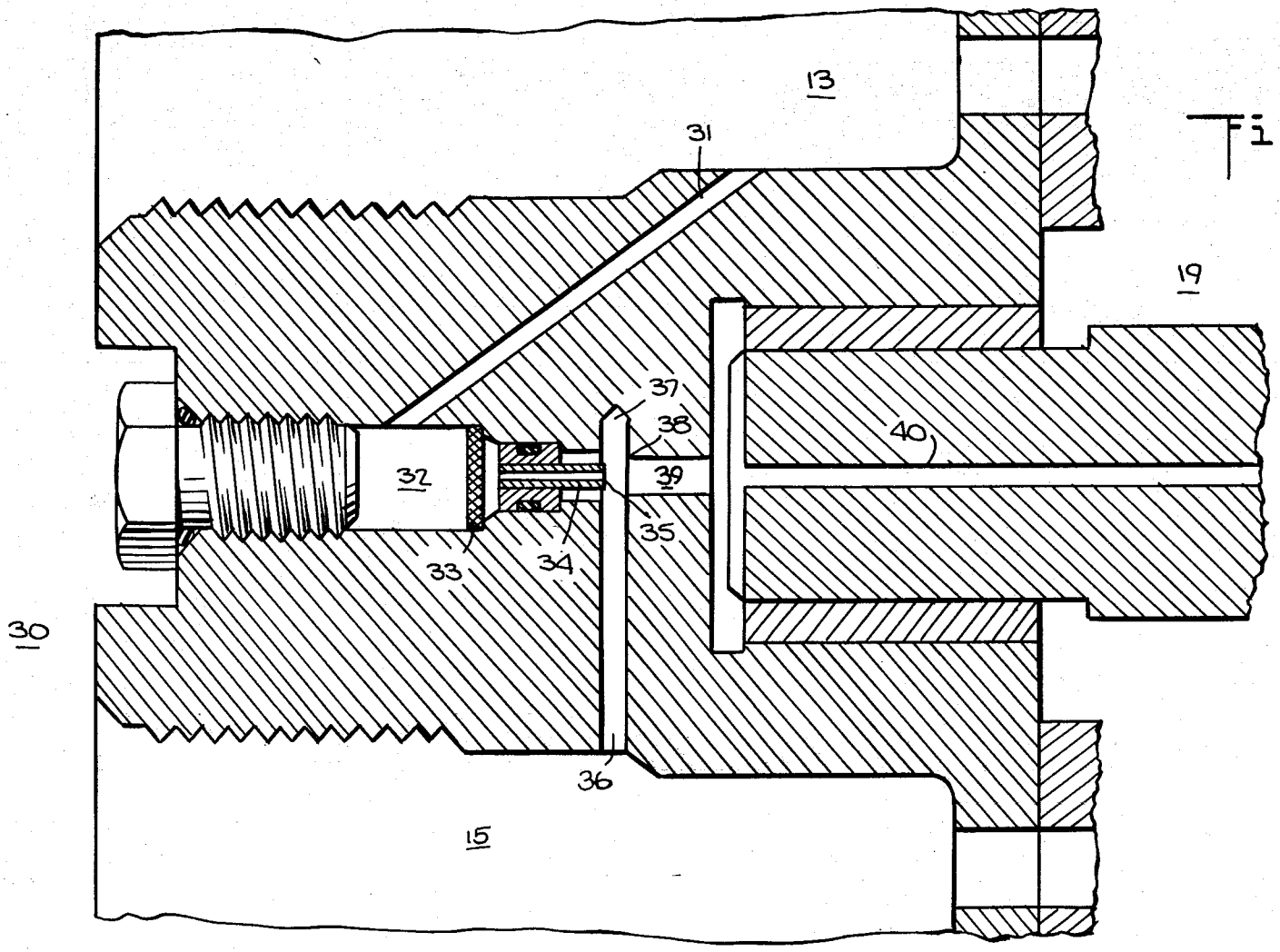
FIG. 2 is an enlarged view of the jet pump portion of FIG. 1.

The jet pump 30 of the subject invention is disposed in the cover 11 of the pump 10. An enlarged view of the jet pump 30 is shown in FIG. 2. There, it is seen that a discharge passageway 31 extends between the discharge chamber 13 and the jet pump chamber 32. A sintered metal filter 33 is placed at one end of the jet pump chamber 32 in order to filter out any fine particles which could adversely intefere with the operation of the jet pump 30. Downstream from the filter 33 is the jet pump nozzle 34 which is terminated in a discharge orifice 35. A portion of the nozzle 34 containing the discharge orifice 35 extends into an inlet cavity 37 that is in fluid communication with inlet chamber 15 via an inlet passageway 36. Opposite the discharge orifice 34 and in axial alignment therewith, is a casing orifice 38 which forms one end of a casing passageway 39. The passageway 39 is in fluid communication with the casing chamber 19 via an axial drive shaft passageway 40, a crosshole 41, and vents 42 (see FIG. 1).

The jet pump 30 of FIGS. 1 and 2 operates in the following manner. Discharge fluid at approximately 3,000 psi enters the jet pump chamber 32 via the discharge passageway 31. The fluid in jet pump chamber 32 passes through filter 33, nozzle 34, and discharge orifice 35. The discharge orifice 35 is small in diameter (as small as 0.010 inches) and can be made from any suitable source, such as a hypodermic needle. The diameter of the discharge orifice 35 can be suitably varied to meet the needs of any particular cooling application.

Due to the relatively high pressure drop from the discharge pressure (3,000 psi) to the pressure in the inlet cavity 37 (e.g. 10 to 50 psi) the velocity of fluid leaving the discharge orifice 35 is very high. The high velocity stream of fluid passes through the casing orifice 38 which is larger in diameter than the discharge orifice 35. As the high velocity stream of oil enters the casing orifice 38, the stream entrains some of the inlet oil contained in the inlet cavity 35 and carries that inlet oil along with the high velocity stream into the casing chamber 19. Ordinarily, oil could not flow from the inlet cavity 37 into the casing chamber 19 since the pressure of fluid in the casing chamber 19 is generally higher than the inlet pressure. The jet stream of fluid passes on through the casing passageway 39 into the shaft passageway 40, through crossholes 41, and vents 42 into the casing chamber 19. In addition, some jet pump discharge will flow into the passageways surrounding bearing 47.

Results from experimental tests indicate that a jet cooled pump 10 having a discharge orifice with a 0.012 inch diameter will pump approximately 0.15 gallons per minute out of a discharge orifice 35 when the discharge pressure is 3,350 psi. When the pressure differential between the inlet cavity 37 and the casing chamber 19 is approximately 55 psi, there will be a net flow into the inlet chamber 19 of 0.61 gpm. Since it is known that the orifice discharges only 0.15 gpm, then the remaining flow (0.46 gpm) is entrained, cooler inlet fluid. In other words, at conditions resembling a neutral situation the jet pump will draw nearly three times its own volume of cooler, inlet fluid in order to cool the temperature of the fluid in the casing chamber 19 and thus the pump 10. As the output flow of pump 10 increases, the difference in pressure between the casing chamber 19 and the inlet chamber 15 will increase, thereby reducing the flow through the casing port 39. However, with increased flow, the pump 10 will cool itself due to the increased volume of cooler, inlet fluid that passes through it.

While the foregoing description of the invention has emphasized the cooling capabilities of the jet pump 30, those skilled in the art appreciate that the pump casing 19 could likewise be heated if such was desired, by introducing hotter fluid into the inlet chamber 15.

Having thus described the salient features of the preferred embodiment of the invention, those skilled in the art will recognize that further improvements and modifications are possible without departing from the spirit and scope of the invention as set forth in the following claims.

What I claim is:

1. A variable displacement pump comprising a pump having an inlet cavity adapted to be connected to a source of inlet fluid, an oulet chamber for receiving outlet fluid of the pump, a casing enclosing a casing chamber and a pumping assembly for drawing fluid from the inlet into the pumping assembly and discharging fluid under pressure into the outlet chamber, a displacement control operatively associated with the pumping assembly for controlling the output pressure or flow or both of the variable displacement pump, and adapted to maintain the output pressure of the pump at a predetermined value when the output flow of the pump is nill, thereby causing the temperature of the fluid in the pump and the pump itself to rise, cooling means for drawing inlet fluid into the pump casing for cooling the pump and the fluid therein comprising:

(a) an inlet cavity in fluid communication with the inlet chamber and the casing chamber, (b) a jet pump operative associated with the inlet cavity and the casing chamber for providing a high velocity stream of fluid directed along a path through the inlet chamber and into the casing chamber, whereby fluid in the inlet cavity is entrained by the jet stream and carried along with the stream into the casing chamber.

2. The pump of claim 1 wherein the jet pump is connected to the pump outlet chamber for receiving a portion of the pressurized fluid, and has a discharge orifice for directing said portion as a high velocity stream of fluid toward the casing chamber.

3. The pump of claim 2 wherein the casing chamber has a port adapted to receive a jet of fluid from the jet pump orifice and the casing jet port is larger than the discharge orifice of the jet pump.

4. The pump of claim 3 further comprising a filter disposed upstream of the discharge orifice in the jet pump.

5. The pump of claim 1 wherein the pumping assembly comprises a variable displacement, axial piston, swashplate pump.

6. A pump comprising a main pump having a casing, an inlet, an outlet, means for pumping fluid from the inlet to the outlet and auxiliary means for drawing inlet fluid into the pump casing for cooling the main pump, said auxiliary means including a jet pump in fluid communication with the outlet, the inlet, and the casing for directing a jet of outlet fluid through inlet fluid and into the casing in order to cool the main pump by entraining inlet fluid along with the jet of outlet fluid from the jet pump.

7. A method for jet cooling a pump casing, such casing having an outlet for discharging high temperature fluid, comprises the steps of:

connecting the outlet of the pump casing to a jet nozzle to divert a portion of the high temperature outlet fluid to the jet nozzle, directing a high velocity jet stream of outlet fluid from the jet nozzle along a path into the pump casing, providing a source of cooler fluid in the path of the jet stream whereby the cooler fluid is entrained by the jet stream and carried into the casing.

* * * * *